US007271369B2

(12) United States Patent
Li et al.

(10) Patent No.: US 7,271,369 B2
(45) Date of Patent: Sep. 18, 2007

(54) MULTILAYER POSITIVE TEMPERATURE COEFFICIENT DEVICE AND METHOD OF MAKING THE SAME

(75) Inventors: Xiang-Ming Li, San Diego, CA (US); Xiaopeng Yang, San Diego, CA (US); Liwu Wang, San Diego, CA (US); Daniel H. Chang, Rancho Santa Fe, CA (US)

(73) Assignee: AEM, Inc., San Diego, CA (US)

( * ) Notice: Subject to any disclaimer, the term of this patent is extended or adjusted under 35 U.S.C. 154(b) by 0 days.

(21) Appl. No.: 11/213,201

(22) Filed: Aug. 26, 2005

(65) Prior Publication Data

US 2007/0045287 A1 Mar. 1, 2007

(51) Int. Cl.
*H05B 1/02* (2006.01)

(52) U.S. Cl. ..... 219/505; 219/539; 219/541; 219/552; 219/549; 338/22 R

(58) Field of Classification Search ..... 219/505, 219/504, 539, 541, 543, 548, 552, 553; 338/22 R, 338/225 C See application file for complete search history.

(56) References Cited

U.S. PATENT DOCUMENTS 3,996,447 A * 12/1976 Bouffard et al. ..... 219/541
5,110,774 A 5/1992 Ogura
5,120,611 A 6/1992 Ogura
5,195,013 A 3/1993 Jacobs et al.
5,271,969 A 12/1993 Ogura
5,858,533 A 1/1999 Greuter et al.
6,007,743 A 12/1999 Asada et al.
6,218,928 B1 4/2001 Okada et al.
6,221,800 B1 4/2001 Takahashi et al.
6,224,790 B1 5/2001 Ishida
6,228,287 B1 5/2001 Wong
6,228,481 B1 5/2001 Yamada et al.
6,245,439 B1 6/2001 Yamada et al.
6,300,862 B1 10/2001 Ishida
6,346,496 B2 2/2002 Nabika et al.
6,359,327 B1 3/2002 Niimi et al.
6,472,972 B1 10/2002 Ishida
6,535,103 B1 * 3/2003 Duggal et al. ..... 338/22 R (Continued)

OTHER PUBLICATIONS

Kainz, "Ceramic PTC thermistors for protection of electronic circuits," Siemens Matsushita Components (1998).

*Primary Examiner*—Mark Paschall
(74) *Attorney, Agent, or Firm*—Morrison & Foerster LLP

(57) ABSTRACT

An improved PTC device and method of manufacturing is disclosed. In one embodiment, the device and method incorporates an improved metal-ceramic composite PTC material manufactured by: (a) heating a ceramic material to a sufficiently high temperature to induce the ceramic material's PTC properties; (b) grinding the ceramic PTC material into a powder; (c) mixing the ceramic PTC material powder with a metal material powder so as to produce a metal-ceramic composite material powder; and (d) sintering the composite material powder at a temperature between 600° and 950° C. In alternative embodiments, an improved multi-layer structure and method of manufacturing such a structure is disclosed. In various embodiments, a PTC device made in accordance with the improved multi-layer structure and method of manufacture may or may not incorporate the improved metal-ceramic composite PTC material disclosed herein, but may use conventional ceramic-based PTC materials.

11 Claims, 7 Drawing Sheets

U.S. PATENT DOCUMENTS 6,547,989 B1 4/2003 Ishida
2001/0052590 A1* 12/2001 Ishida ..... 252/500
2002/0114950 A1 8/2002 Akimoto et al.

* cited by examiner

MULTILAYER POSITIVE TEMPERATURE COEFFICIENT DEVICE AND METHOD OF MAKING THE SAME

BACKGROUND OF THE INVENTION

1. Technical Field

The present invention relates to positive temperature coefficient (PTC) device and, more particularly, to improved ceramic-based PTC devices and methods of making same.

2. Description of Related Art

As is known in the art, PTC materials exhibit electrical resistivity that increases with increasing temperature. For some PTC materials, electrical resistivity increases sharply above a certain temperature to significantly restrict an electrical current flow through the material. As the PTC material is heated due to electrical current, negative feedback results from increased resistance, which in turn results from the increased material temperature. This feature makes PTC materials suitable for use, for example, in current surge protection devices that limit the electrical current levels that pass through them. Such devices are used to protect electrically powered devices from transient current surges on power supply lines, to protect electrical power sources from overload current drains, or to generally protect electrical equipment in the event that electrical currents exceed design limitations for one reason or another.

Because the temperature rise in a PTC material that results from an electrical current increase is not instantaneous, owing to the thermal mass of the PTC material, the PTC material can also be used to make a time-delayed switch. In a case where the heat produced by an electric current in a PTC material makes it useful as an electrical heating element, the PTC behavior can provide thermostatic self-regulation. Also, PTC devices may be used to sense temperature by measuring the voltage drop across them in response to an electrical current that is low enough to produce negligible self-heating. Some common types of PTC-based electronic components are resettable fuses and thermistors.

Two well known classes of PTC materials are polymer-based and ceramic-based PTC materials.

Many different types of polymers, copolymers, and mixtures of polymers are known in the art as suitable for use in the manufacture of PTC materials. For example, a material of low resistivity particles such as carbon, embedded in a high resistivity organic polymer matrix such as polyethylene, exhibits low electrical resistance at room temperature (e.g., 25° C.) if the concentration of the low resistivity particles is sufficient to form conductive paths through the material. Because the thermal expansion coefficient of the polymer is much greater than that of the low resistivity particles, the polymer matrix expands more than the conductive carbon particles embedded therein when the composite material is heated. Consequently, conductive contact among adjacent carbon particles is diminished as the carbon particles are carried away from one another by the expanding polymer matrix, thereby increasing the electrical resistivity of the composite material.

When an organic substance such as a polymer is used as a high resistivity matrix in a PTC composite material, however, prolonged high temperatures or repeated temperature cycling can degrade the structural integrity of the composite material. This can result in a change of overall resistivity versus temperature characteristics. This may even result in catastrophic failure resulting from excessive heating due to runaway current densities that may be caused by micro-structural failure of the composite material resulting from localized high conductivity, high current regions. This breakdown of polymer-based composite materials is largely due to diminished chemical stability of the polymer material at elevated temperatures. Consequently, conventional polymer composite materials do not allow for reliable repeated operation, because the resistivity characteristic of the material, especially after a trip condition, does not return to its prior state.

Ceramic-based PTC materials, such as barium titanate type ceramics, exhibit sharply increasing resistivity in response to increasing temperature (i.e., PTC behavior) above a certain temperature threshold, and are more chemically and physically stable than polymer-based materials at elevated temperatures. Although ceramic-based PTC materials are more reliable than polymer-based PTC materials, one drawback of ceramic-based PTC materials is that they are characterized by relatively high resistivity (e.g., 30 Ω-cm) at room temperature when compared to polymer-based PTC materials (e.g., 3 Ω-cm). Thus at room temperature operating conditions, for example, ceramic-based PTC materials exhibit a higher power loss than polymer-based PCT materials when conducting the same level of electrical current through devices having the same or similar dimensions. This is a drawback for ceramic-based PTC material devices in many applications where power loss is to be minimized.

One type of composite material that has been proposed to overcome the deficiencies of polymer-based PTC materials and ceramic-based PTC materials such as those discussed above is disclosed in U.S. Pat. No. 6,300,862 to Ishida (hereafter "Ishida"). Ishida describes a PTC composite material that includes a matrix of ceramic material having one of a cristobalite crystal structure and a tridymite crystal structure, each doped with an oxide of at least one of Be, B, Mg, Al, Ca, Sc, Ti, V, Cr, Mn, Fe, Co, Ni, Cu, Zn, Ga, and Ge, and a conductive phase dispersed throughout the matrix. The conductive phase includes at least one of a metal, silicide, nitride, carbide, and boride.

The ceramic material disclosed by Ishida is a special type of ceramic material having a cristobalite or tridymite crystal structure and which is doped with an oxide. This manufactured ceramic material behaves very much like a polymer-based PTC material because when it is heated, the ceramic matrix expands in volume and breaks conductive paths formed by conductive particles dispersed throughout the matrix. In contrast, other types of ceramic PTC materials (e.g., doped barium titanate) do not expand significantly when heated. Although Ishida's composite material exhibits lower room temperature resistance when compared to other ceramic-based PTC materials, it still suffers from many disadvantages as described in the Ishida patent specification. For example, if the volume expansion of the crystal structure ceramic is less than a certain amount, the composite material does not exhibit sufficient resistivity jump at the trip-point temperature. Alternatively, if the volume expansion is more than an upper limit, the composite material may experience stress cracking at the interface between the matrix and the conductive phase. Thus, the manufacture of the ceramic material itself, as well as the manufacture of the overall composite material, requires great care, precision, and expense to ensure that particle sizes are within requisite ranges and the ceramic material exhibits desired expansion characteristics. In sum, the materials and manufacturing process utilized by Ishida are expensive, time consuming, and difficult to consistently repeat for mass production.

U.S. Pat. No. 6,359,327 to Niimi et al. (hereafter "Niimi") discloses a monolithic PTC device that includes a sintered laminate formed of alternating, stacked semiconductor ceramic layers and interleaved electrode layers. The ceramic layers comprise a sintered barium titanate containing a boron oxide. The internal electrodes are formed from a base metal such as nickel (Ni), copper (Co), iron (Fe) or molybdenum (Mo). A preferred base metal is identified as Ni.

Niimi discloses that the ceramic PTC material comprises various mixtures of $BaCO_3$, $Sm_2O_3$, BN and $MnCO_3$ added to the barium titanate to improve its PTC properties. This ceramic material is then used as the ceramic layer of the sintered laminate described above. Niimi further discloses that a monolithic PTC device, having the laminate of alternating stacked ceramic and Ni layers, and external electrodes formed on the laminate, can be efficiently manufactured by co-firing the monolithic device at 950° C. in a hydrogen/nitrogen reducing atmosphere chamber, followed by a second firing at 800° C. in air.

Although the process disclosed by Niimi allows co-firing of an entire monolithic device at relatively low temperature (e.g., 950° C.), this advantage is diminished by the fact that the process requires a reducing atmosphere chamber and related equipment. Such equipment is expensive and difficult to control in terms of maintaining process parameters during operation. Additionally, the process disclosed by Niimi requires a second firing step, which adds to the time and cost of the manufacturing process. Furthermore, the ceramic PTC used by Niimi still suffers from high resistivity (approximately 30 ohm-cm) at room temperature. Therefore, many parallel layers of ceramic PTC material are required to make a ceramic PTC device having a low resistance (e.g., 0.01 to 0.1 Ω-cm) and, consequently, low power consumption.

Although U.S. Pat. No. 6,245,439 to Yamada et al. (hereafter "Yamada") discloses a thermistor made from a composite material comprising a ceramic material and a metal material, Yamada is concerned primarily with providing composite materials with improved interphase mechanical bonding. Yamada does not address improving the specific electrical/PTC properties of prior PTC materials. Nor does Yamada address the problems associated with prior polymer-based and ceramic-based PTC materials, as discussed above. Nor does Yamada address how to establish strong ohmic bonding between the metal phase and the ceramic PTC phase. Failure to establish such ohmic bonding (or electrical connection) between the metal phase and ceramic phase, results in a high overall resistance of the composite material.

Thus, what is desired is an improved ceramic or ceramic composite PTC device having improved PTC properties. The improved PTC device should exhibit low resistance at room temperature and a large resistance jump at a tripping temperature of the PTC material. Additionally, the improved PTC device should not substantially degrade as a result of prolonged or repeated exposure to a tripping temperature/fault current. It is further desirable that the improved PTC device can be fired at relatively low temperatures (e.g., between 600 and 900° C.) such that the firing can be performed after assembly of a monolithic multi-layer device containing the PTC material and other electrodes that require low co-firing temperatures. It is further desirable that an improved composite PTC material utilizes relatively inexpensive materials and can be fired in relatively low cost furnaces operating in atmospheric conditions.

BRIEF SUMMARY OF THE INVENTION

In various embodiments, the invention addresses one or more of the above needs and desires by providing an improved ceramic-based PTC device having an improved metal-ceramic composite PTC material therein and/or an improved multi-layer architecture as described herein. This improved PTC device exhibits low resistance at room temperature and improved reliability after prolonged or repeated exposure to a tripping temperature.

In one embodiment of the invention, the improved ceramic-based PTC device can be sintered at relatively low temperatures in an air atmosphere for lower manufacturing costs and manufacturing equipment costs.

In a further embodiment, the improved PTC device is made from relatively inexpensive starting materials.

In one embodiment, a method of manufacturing a metal-ceramic composite PTC material includes the steps of: (a) mixing a ceramic PTC material powder with a metal powder so as to produce a composite powder; and (b) sintering the composite powder at a temperature less than 1000° C. (preferably between 600 and 900° C.), wherein the metal powder comprises at least one first type of particle, selected from a first group consisting of silver and silver alloy, and at least one second type of particle selected from a second group consisting of zinc, tin, indium, gallium and copper. In further embodiments, the metal powder can be a mixture of different types of metals, as listed above, and/or their alloys. Additionally, the metal powder can comprise metal particles from a first group and coated with metal from a second group.

In a further embodiment, a method of manufacturing a metal-ceramic composite PTC material includes the steps of: (a) heating a ceramic material to a sufficiently high temperature (e.g., 1300° C.) to induce the ceramic material's PTC properties; (b) grinding the resulting ceramic PTC material into a powder; (c) mixing the ceramic PTC material powder with one or more metal powder so as to produce a composite ceramic-metal powder; and (d) sintering the composite powder at a temperature less than 1000° C. As used herein, the term metal refers to any known metal, metal-alloy or other material with similar electrical conductive properties or characteristics.

In another embodiment, a method of manufacturing a PTC device includes the steps of: (a) heating a ceramic material to a sufficiently high temperature (e.g., 1300° C.) to induce the ceramic material's PTC properties; (b) grinding the resulting ceramic PTC material into a powder; (c) mixing the ceramic PTC material powder with a metal powder so as to produce a composite metal-ceramic material; (d) forming a structure of alternating stacked layers comprising at least one layer of the metal-ceramic composite material and at least one metal electrode layer; and (e) sintering the structure at a temperature less than 1000° C.

In a further embodiment, an improved ceramic-based PTC device is formed by stacking multiple structures together, each structure comprising at least one layer of ceramic-based PTC material, an ohmic electrode layer on each side of the PTC material layer, and an external metal electrode layer adjacent to each ohmic electrode layer such that each ohmic layer on each side of the PTC material layer is sandwiched between the PTC material layer and the external electrode layer. The ohmic electrode layer and the external metal electrode layer combine to form an improved electrode. When the multi-layer structure, as described above, is stacked with another similar multi-layer structure, in one embodiment, the external electrode of a first structure is soldered with an adjacent external electrode of a second structure. Thereafter, every other electrode (comprising an ohmic electrode and an external metal electrode) are then electrically coupled together to form a first lead of the device. The remaining alternating electrodes are then connected to form a second lead of the device. In one embodiment, the ceramic-based PTC material of this improved PTC device comprises an improved metal-ceramic composite PTC material described herein.

DETAILED DESCRIPTION OF THE PREFERRED EMBODIMENTS OF THE INVENTION

Figure 1:
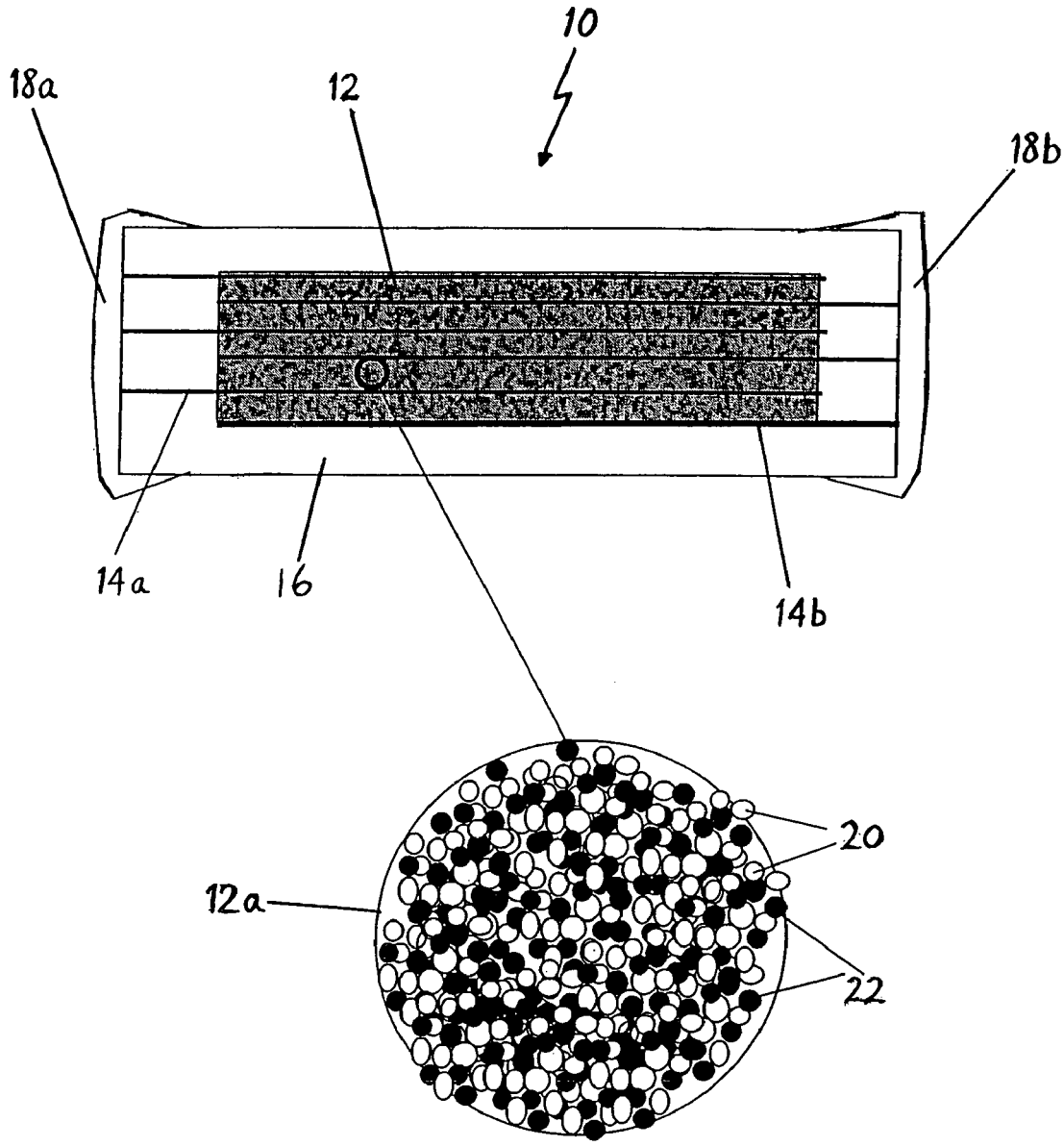
FIG. 1 illustrates a cross-sectional side view of a resettable fuse having multiple layers of a metal-ceramic composite PTC material, including a microscopic view of a portion of the metal-ceramic composite PTC material, in accordance with one embodiment of the invention.

Preferred embodiments of the invention are described in detail below with reference to the figures wherein like elements are referenced with like numerals throughout. FIG. 1 illustrates a cross sectional view of a multilayer resettable fuse device 10 utilizing metal-ceramic composite PTC material layers 12 interleaved with alternating internal metal electrode layers 14*a* and 14*b*, in accordance with one embodiment of the invention. The metal-ceramic composite PTC material layers 12 and the electrode layers 14*a* and 14*b* are encapsulate by an insulating material 16 which forms an external package 16 of the device 10. In preferred embodiments, the insulating material 16 may comprise any known material, such as, glass, glass-ceramic, and/or polymer materials, suitable for electronic device packaging. The device 10 further includes external metal end terminations or contacts 18*a* and 18*b* attached at opposing ends of the package 16. As shown in FIG. 1, a first external contact 18*a* is electrically coupled to a plurality of first internal metal electrodes 14*a* and a second external contact 18*b* is electrically coupled to a plurality of second metal electrodes 14*b*.

In one embodiment, the metal-ceramic composite PTC material 12 is manufactured using metal and/or metal alloy powders mixed with a ceramic PTC (Positive Temperature Coefficient) powder to form a composite material that can be sintered between 500-900° C. This relatively low sintering temperature reduces potential damage to a furnace used for firing, consequently reducing the cost of maintaining the furnace, and further reduces energy consumption. Additionally, the lower sintering temperatures allow the metal-ceramic composite PTC material 12 to be simultaneously co-fired with other structures in the device 10, such as the internal metal electrodes 14*a* and 14*b*, using relatively low cost metals, like silver without significant oxidation in atmospheric condition. At higher temperatures (e.g., 1300° C.) the electrodes 14*a* and 14*b* must be made of expensive metals like palladium or platinum to be fired under atmospheric conditions. Alternatively, the electrodes 14*a* and 14*b* can be made of low cost nickel which must be fired in an expensive reduced-atmosphere furnace as taught by Niimi, discussed above. Thus, the low temperature co-firing capability provided by the present invention, enable the making of highly reliable monolithic components at low materials and equipment costs.

Ceramic PTC materials, such as doped barium titanate, are well known in the art and have been used for making PTC devices, such as thermistors, heating elements, and resettable fuses, for many years. Some major suppliers of ceramic PTC materials are EPCOS, Murata, TDK, Matsushita Hokkaido, and GE-Thermometrics. In order to bring about the PTC properties of the ceramic material, the material is typically fired (i.e., heated) at a high temperature, around 1300° C. This firing process alters the electrical characteristics of the ceramic material such that its resistivity at room temperature is reduced but increases substantially at or near a higher "tripping" temperature.

As mentioned above, however, the resistivity of the ceramic PTC material is relatively high at room temperature when compared with polymer-based PTC materials, for example. Thus, in order to minimize power consumption during normal operating conditions of an over-current protective device, it is desirable to reduce the resistivity of the ceramic PTC material.

Referring again to FIG. 1, a microscopic view of the metal-ceramic PTC material is provided as a magnified circular cross-sectional view 12*a*, in accordance with one embodiment of the invention. It is understood that view 12*a* is provided for purposes of illustration only and does not necessarily represent actual particle numbers, sizes, shapes and densities, which may vary depending on the PTC properties and characteristics desired. The composite PTC material comprises a plurality of ceramic PTC material particles 20 that form a semiconducting PTC matrix or particle network 20. A plurality of electrically conductive metal and/or metal alloy particles 22 are dispersed throughout the ceramic PTC material matrix 20. As used herein, the term "metal" generally encompasses, either collectively or individually, any metal (e.g., silver, zinc, tin, etc.), any metal alloy (e.g., silver alloy particles), or any mixture of metal(s) and metal alloy(s), or metal particles coated with another metal.

When the metal particles 22 are mixed with the ceramic PTC material particles 20 in desired quantities/ratios, the metal particles 22, together with the ceramic PTC particles 20, form a composite PTC material which exhibits dramatically lower resistance at room temperature and desired increased resistance at a tripping temperature. The amount of metal particles 22 is maintained below a level such that a complete conductive network or pathway is not formed solely by the metal particles 22 between the external contacts 18*a* and 18*b*. In this way, the metal particles 22 do not form a "short circuit" between the external contacts 18*a* and 18*b* but still substantially decreases the overall resistance of the composite PTC material 12 by decreasing the effective or apparent resistance of the composite material 12.

In one embodiment, the metal particles 22 comprise silver (Ag) particles mixed with zinc (Zn) and/or tin (Sn) particles in desired quantity ratios. In one embodiment, the metal particles comprise 40-90% by weight silver particles, 5-30% by weight zinc particles, and 5-30% by weight tin particles. In another embodiment, the metal particles comprise approximately 60% by weight silver particles, approximately 20% by weight zinc particles, and approximately 20% by weight tin particles.

As is known in the art, silver is a noble metal which exhibits relatively stable physical and chemical characteristics. Tin and zinc are base metals which oxidize more easily and, therefore, allow strong Ohmic (electrical) and structural bonding between the metal particles 22 and the ceramic PTC particles 20 when the particles are sintered together. As mentioned above, in one embodiment, the metal particles 22 and ceramic PTC particles 20 are sintered together at a temperature range of 600-900° C. In one embodiment, the sintering temperature is approximately 650° C. In a further embodiment, base metals such as indium, gallium and copper may be used instead of or in addition to zinc and tin. Alternatively, or additionally, silver alloys containing these base metals may also be used. In a further embodiment, a silver alloy may be used instead of or in addition to pure silver particles. In another embodiment, silver particles coated with zinc, or nickel, or tine may be used.

The quantity of metal particles 22 should be controlled such that an electrically conductive network or uninterrupted conductive pathway through the metal phase is not formed between the external contact elements 18*a* and 18*b*. In one embodiment, the quantity of metal particles 22 by volume is less than 50% of the total volume of the composite PTC material 12. The amount of metal particles 22 also depends upon a desired level of resistivity of the composite PTC material 12. In one embodiment, the quantity of metal particles 22 by volume is in the range of 10-30%.

Figure 2:
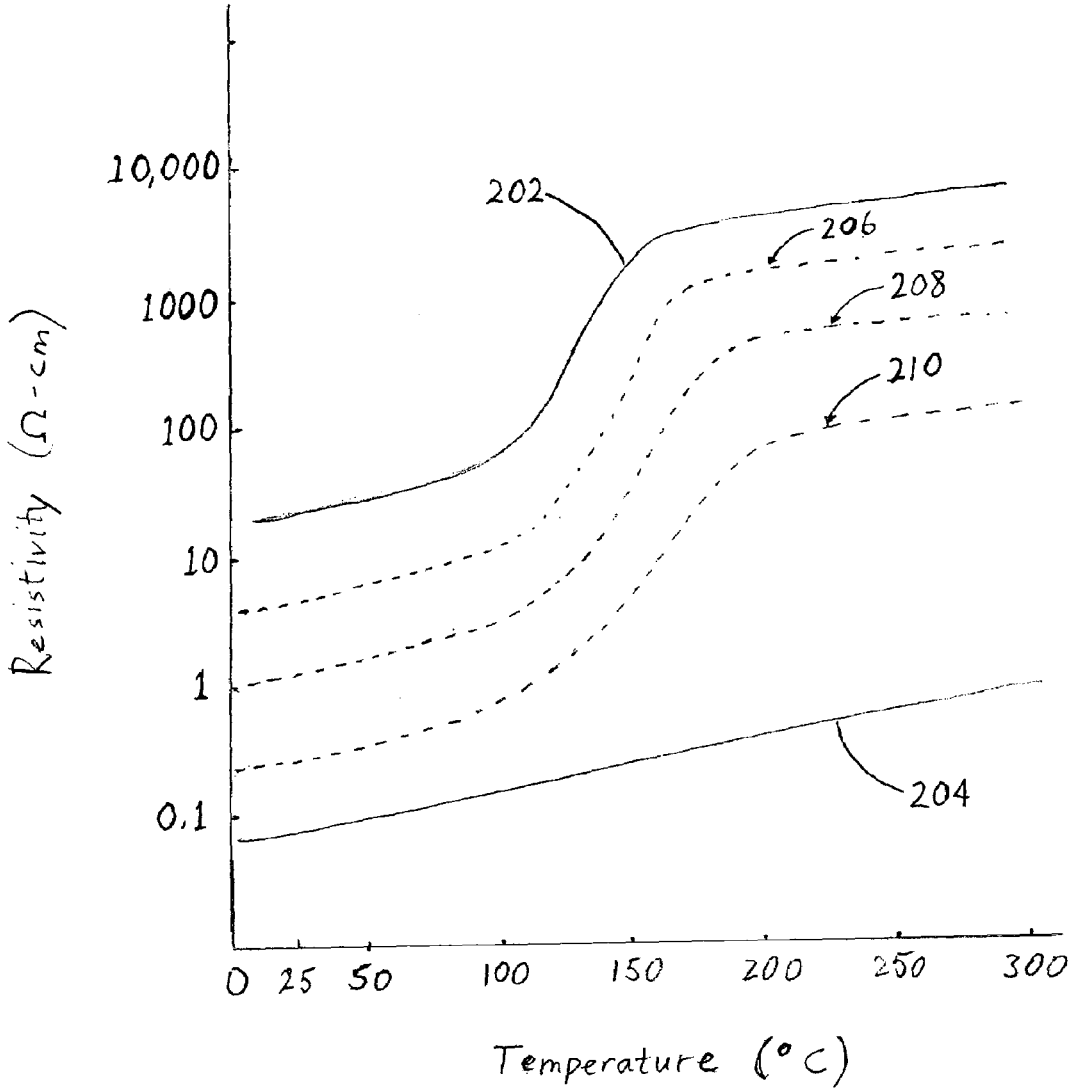
FIG. 2 illustrates a series graph curves representing resistance vs. temperature profiles of various materials, in accordance with various embodiments of the invention.

FIG. 2 provides a series of graph curves that illustrate the resistance vs. temperature profiles of various materials composed of varying quantity ratios of ceramic PTC and metal materials. The top most graph curve 202 illustrates the resistance vs. temperature profile of a conventional ceramic PTC material (e.g., barium titanate) without any metal particles dispersed in the ceramic PTC matrix. At room temperature (25° C.), the resistance is approximately 30 Ω-cm. At a higher tripping temperature (e.g., between 80-150° C.), however, one can see that the resistance of the ceramic PTC material dramatically increases. [Thus, the ceramic PTC material exhibits a strong PTC characteristic.

In contrast, the resistance vs. temperature profile 204 of pure metal exhibits almost no PTC behavior. It has a very low resistance at room temperature and maintains a relatively flat profile as temperature increases.

The intermediate graph curves shown as dashed lines represent resistance vs. temperature profiles of metal-ceramic composite PTC materials, in accordance with various embodiments of the invention. The top most composite PTC material curve 206 has a higher percentage of ceramic PTC material vs. metal material than the dashed-line curves 208 and 210 beneath it and, therefore, has a PTC characteristic that is more similar to the ceramic PTC profile 202. As the percentage of metal material in the composition increases, the PTC profile of the composite material becomes flatter and approaches the profile of pure metal. Additionally, as the percentage of metal in the composite material increases, the resistance at room temperature also decreases. Thus, by controlling the percentage of metal particles in the composite material, while avoiding creation of an uninterrupted metal network or conductive pathway, the composite material of the present invention can exhibit relatively good PTC characteristics while having low resistance at room temperature.

Figure 3:
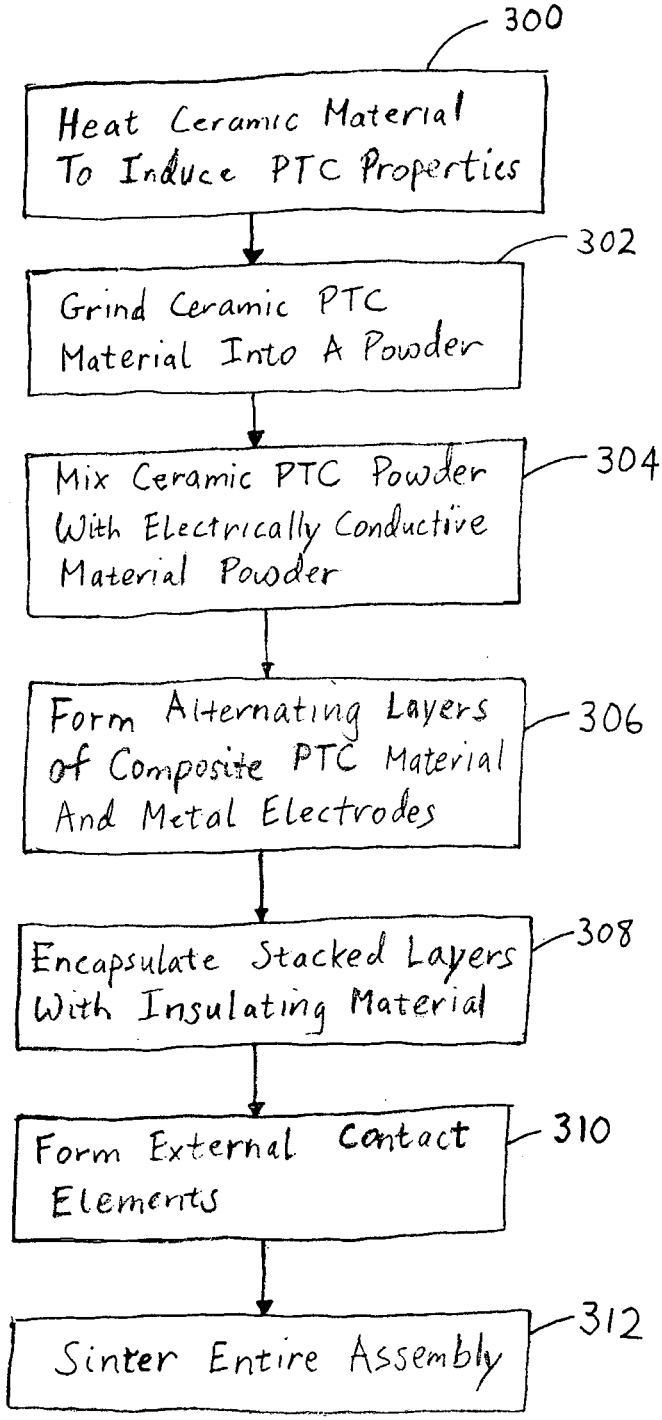
FIG. 3 illustrates a flow chart that provides an overview of one method of manufacturing an electrically conductive-ceramic composite material PTC device, in accordance with embodiment of the invention.

FIG. 3 illustrates a flow chart providing a high-level overview of one method of manufacturing a PTC device, in accordance with a further embodiment of the invention. At step 300, a ceramic PTC material (e.g., doped barium titanate) is heated to a predetermined temperature (e.g., 1300° C.) in order to induce its PTC properties. Next, at step 302, the resulting PTC material is ground into a fine powder. At step 304, the ceramic PTC powder is mixed with a metal powder (or mixture of metal powders) at desired quantity ratios. This mixing may be performed in accordance with known mixing techniques in the art such as high-shear mixing (e.g., roll milling, bead milling, high speed stirring, etc.) to uniformly mix the powders. In one embodiment, the powders are mixed in an alcohol solution and the resulting mixture forms a metal-ceramic composite PTC material paste.

Next, at step 306, layers 12 of the composite PTC paste are stacked with internal electrode layers 14*a* and 14*b* in an alternating fashion as shown in FIG. 1. At step 308, the stack of composite material layers 12 and internal electrodes 14*a* and 14*b* is encapsulated with the insulating material 16 such that respective end portions of the electrode layers 14*a* and 14*b* remain exposed for electrical contact with respective external contact elements 18*a* and 18*b*, which are attached at opposing ends of the insulating material 16 at step 310. At step 312, the monolithic chip-type assembly is sintered at a firing temperature between 500-900° C. This sintering process enables the metal particles 22 to mechanically and electrically bond with the ceramic PTC particles 20 in the composite material 12. Simultaneously, the composite material 12 mechanically and electrically bonds with the internal electrodes 14*a* and 14*b*, which in turn bond with the insulating material 16 and respective external contact elements 18*a* and 18*b*. In one embodiment, the sintering process is performed at a temperature of 650° C.

Thus, as described above, the low sintering temperature of the composite material 12 enables it to be sintered simultaneous with other structures (e.g., internal electrodes 14*a* and 14*b*, external contacts 18*a* and 18*b* ) contained within a multi-layer monolithic chip-type device. This enables fast and cost-efficient manufacturing of the device.

Figure 4:
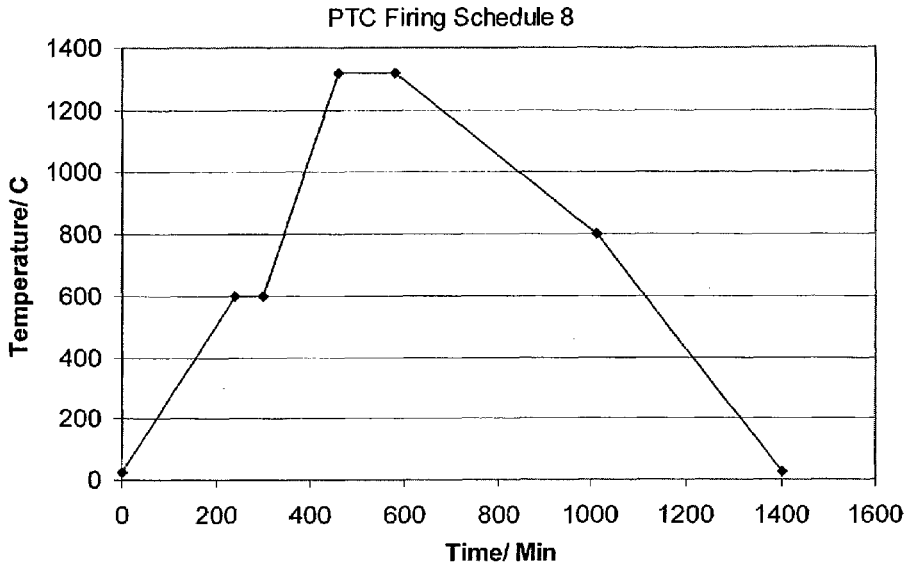
FIG. 4 illustrates a graph chart of a PTC firing schedule, in accordance with one embodiment of the invention.

FIG. 4 illustrates a firing schedule used for a ceramic powder material in order to bring about its PTC properties, prior to mixing with metal particles 22, in accordance with one embodiment of the invention. As shown in FIG. 4, the ceramic powder is gradually heated and then held at a temperature of approximately 600° C. for one hour. This phase helps remove any binders from the spray-dried powder. Next, the ceramic powder is held at a temperature of 1320° C. for two hours in order to help optimize the densification of the ceramic powder. The powder is then gradually cooled.

The ceramic PTC particles are then milled such that average particles sizes range from 1 to 15 microns. The milled ceramic PTC powder is then mixed with an ohmic metal powder (e.g., silver, tin and zinc mixture) to obtain a well dispersed homogeneous mixture. In one embodiment, the ohmic metal powder comprises 50% silver, 15% tin and 35% zinc, by weight. Table 1 below shows the composition of a composite powder mixture (named by the inventors as "COM-16") that shows a PTC property. Next, isopropyl alcohol is added to the mixture to form a thick slurry. This thick slurry is preferred because sedimentation of composite powder mixture is slowed down. In one embodiment, 0.2% weight percent of an organic binder (e.g., PVB) is added into the slurry to facilitate subsequent pressing of the material.

TABLE 1

| | Ohmic powder | | CPTC | |
|---|---|---|---|---|
| COM-16 | Weight % | Weight | Weight % | Weight |
| | 25 | 6.25 | 75 | 18.75 |

After adequate mixing, the homogenous slurry is dried in an oven at 105° C. to remove the isopropyl alcohol. Next, the powder block is crushed into fine powder in a mortar. The composite PTC powder is now ready for further pressing and testing. In one embodiment, the composite PTC powder is placed into a metal die and pressed at 5000 psi pressure to form substantially flat disks.

Next, the pressed disks are placed on top of a zirconia setter and placed into a tunnel oven that is divided into four heating zones. The disks pass through the tunnel oven and, in one embodiment, are fired with a 500-650-650-500 temperature profile in air to obtain good ohmic contact between metal particles and ceramic particles. The total firing time is approximately sixty minutes and the time in each zone is about fifteen minutes. Better mechanical strength is also achieved through firing. It is understood that this temperature profile is exemplary only and that other temperature profiles may be implemented at the various stages of the process described above, in accordance with the present invention.

Figure 5:
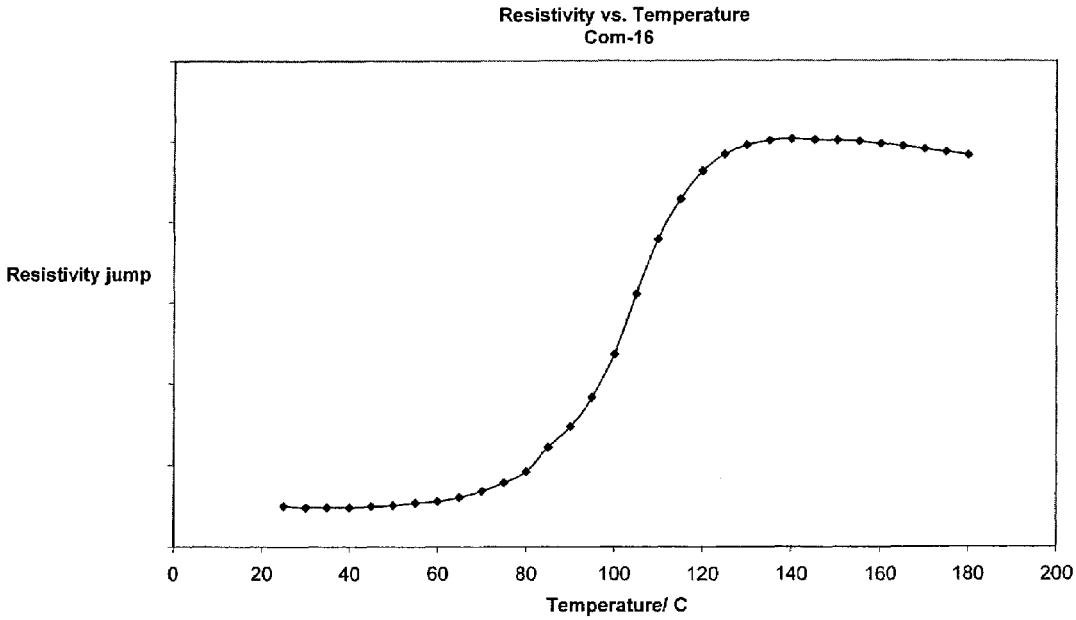
FIG. 5 illustrates a Resistivity v. Temperature graph chart of the PTC material, in accordance with one embodiment of the invention.

The resulting disks were tested to confirm their PTC property. The disks were placed into a programmable oven and gradually heated. The temperature of the disk was measured with a J-type thermal couple, which was put close to the surface of each disk. The resistance of the disks was measured with a Keithley source meter. FIG. 5 shows a typical resistivity vs. temperature curve of the composite PTC material disks that were tested.

Figure 6:
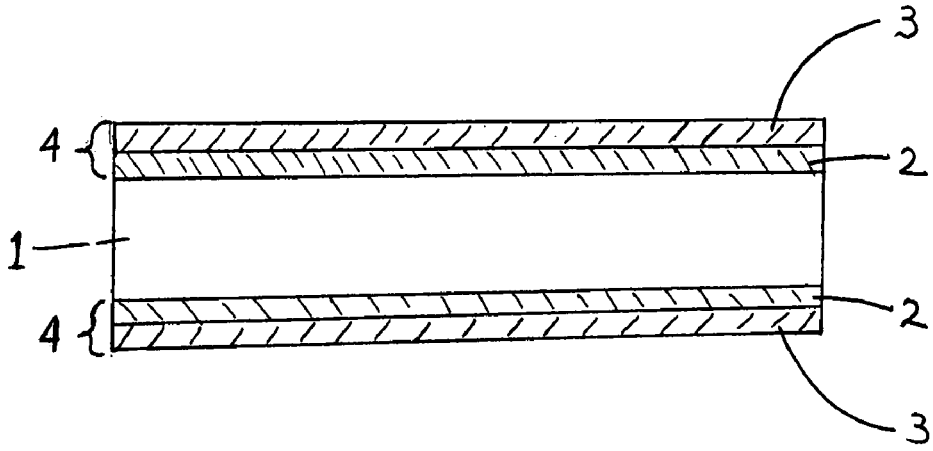
FIG. 6 illustrates a cross-sectional view of a single layer of PTC material sandwiched between two ohmic electrodes and two external electrodes, in accordance with one embodiment of the invention.

Referring to FIG. 6, after a disk 1 is fired, as described above, an ohmic layer 2 is applied on each side of the disk 1. In one embodiment, the ohmic layer 2 comprises a layer of silver mixed with a base metal such as tin or zinc. In one embodiment, the ohmic layer 2 comprises 50-60% silver, 25-35% zinc and 10-20% tin. The disk 1 with the ohmic layers 2 is then fired in tunnel oven with the 500-650-650-500° C. profile. Next, a metal layer 3 is applied on both sides of the disk 1 and ohmic layer 2 structure, such that each metal layer 3 is adjacent to and covers the ohmic layer 2 on both sides of the disk 1. In one embodiment, the metal layers 3 comprise a metal layer of pure silver. This structure, consisting of the disk 1 middle layer, ohmic layers 2 and metal layers 3 on both sides of the disk 1 is then fired under the same 500-650-650-500 temperature profiled described above. The resulting electrode layer 4 on both sides of the PTC material layer 1 comprises an ohmic layer 2 sintered together with a metal layer 3.

Figure 7:
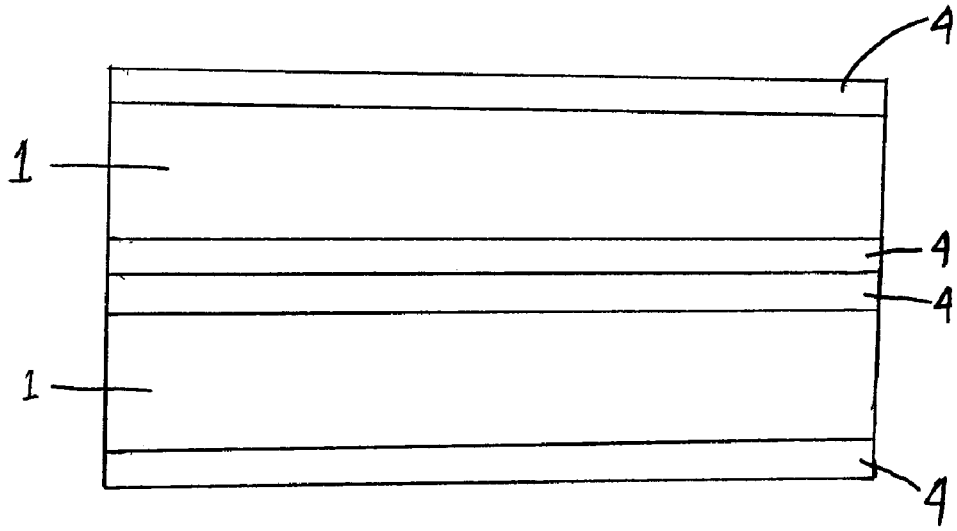
FIG. 7 illustrates a cross-sectional view of a multi-layer PTC device, in accordance with one embodiment of the invention.

FIG. 7 illustrates a multi-layer PTC structure comprising at least two layers of PTC material 1 separated by electrode layers 4, in accordance with one embodiment of the invention. Electrode layers 4 also cover the top and bottom surfaces of the multi-layer PTC structure. In one embodiment, the two middle electrode layers 4 are soldered together using conventional soldering techniques. However, other methods of providing electrical contact between the electrode layers 4 (e.g., using conductive polymer adhesives) may be utilized in accordance with the present invention.

Figure 8:
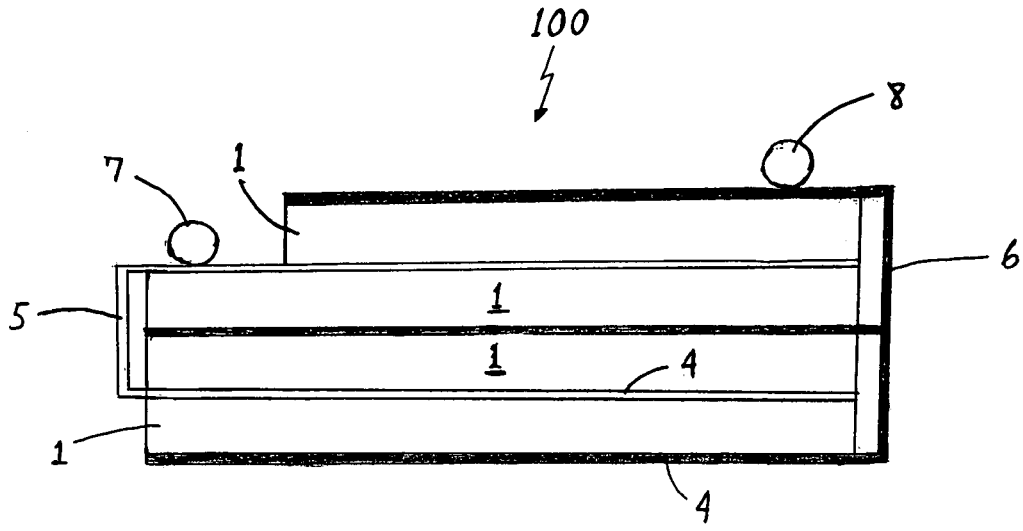
FIG. 8 illustrates a cross-sectional view of a multi-layer PTC device, in accordance with another embodiment of the invention.

FIG. 8 shows the cross-section view of multilayer PTC resettable fuse, in accordance with one embodiment of the invention. In the particular example illustrated, four layers of PTC material 1 are separated from each other by three electrode layers 4 and 4'. Two additional outer electrode layers 4 cover the top and bottom surfaces of the multi-layer resettable fuse. Each of the electrode layers 4 or 4' may actually comprise one or more electrode layers 4 soldered or adhered together, as discussed above. A first group of electrodes 4' are electrically connected in parallel to one another by a connector 5 to form a first group of parallel electrodes. A second group of electrodes 4 are electrically connected in parallel by connector 6 to form a second group of parallel electrodes. This design greatly lowers the resistance of the PTC resettable fuse, while keeping the materials and processing cost low compared with devices having precious metal electrodes or requiring reduction firing.

Figure 9:
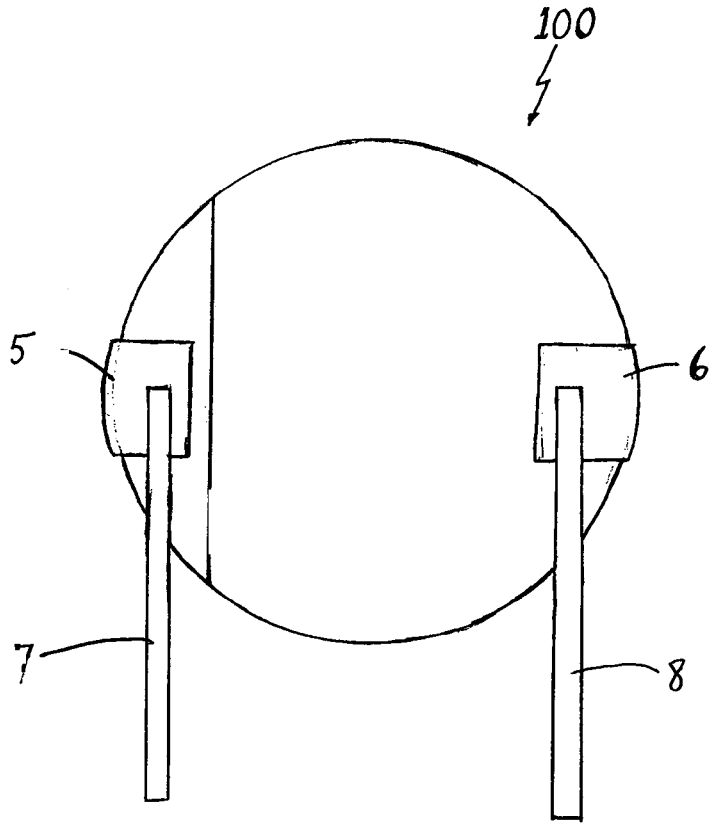
FIG. 9 illustrates a top view of the PTC device of FIG. 8.

FIG. 9 illustrates a top view of the disk-type PTC resettable fuse of FIG. 8. To form this resettable fuse, a plurality of disks are fired and ohmic and metal layers are applied on both surfaces of each disk, as described above. A small portion of the top-most disk is removed with sand paper to reveal a portion of an underlying electrode 4'. The plurality of disks are joined with solder between neighboring external electrodes at an elevated temperature depending on the nature of the solder used. The top and bottom (not shown) surfaces are connected with a copper connector 6, which is clamped and soldered on the surfaces. In one embodiment, the connector 5 is also clamped and soldered to provide an electrical connection between two electrodes 4', as shown in FIG. 8. Two leads 7 and 8 are then electrically connected to inner electrodes 4' and outer electrodes 4, respectively.

In one embodiment, the diameter of the ceramic disks 1 is around 16.3 mm and the thickness of ceramic disks is approximately 0.5 mm. The resistance of a single-layer PTC resettable fuse was found to be approximately 0.32 ohm. However, the resistance of a double layer PTC resettable fuse was measured to be approximately 0.18 ohm.

Figure 10:
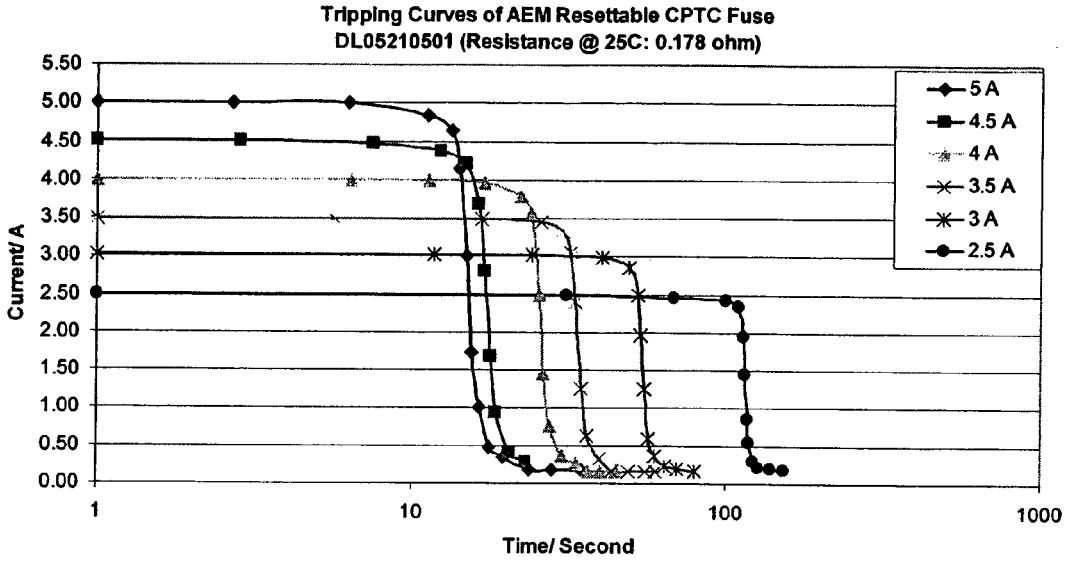
FIG. 10 illustrates the tripping curves (current vs. time) obtained by testing a device made in accordance with one embodiment of the invention.

FIG. 10 shows the trip curves of a double layer disk-type PTC resettable fuse made in accordance with one embodiment of the present invention, at various initial currents.

Although, the multi-layer PTC resetable fuse of the invention can use an improved metal-ceramic composite PTC material as described herein, in alternative embodiments, a multi-layer PTC resettable fuse may use conventional ceramic-based PTC materials. It is understood that the architecture and process for creating a multi-layer PTC device as described above, even when utilizing conventional ceramic-based PTC material layers, will also provide significant advantages to prior art ceramic-based PTC devices. For example, as discussed above, the resistivity of a double-layer device is reduced to approximately one-half or less when compared with conventional devices having the same footprint.

Various preferred embodiments of the invention have been described above. However, it is understood that these various embodiments are exemplary only and should not limit the scope of the invention as recited in the claims below. Various modifications of the preferred embodiments described above can be implemented by those of ordinary skill in the art, without undue experimentation. These various modifications are contemplated to be within the spirit and scope of the invention as set forth in the claims below.

What is claimed is:

1. A method of manufacturing a PTC device, comprising:

(a) placing an ohmic layer on each side of a first PTC material layer;

(b) firing the first PTC material layer and the ohmic layers in accordance with a predefined temperature profile;

(c) placing external metal layers over each ohmic layer on both sides of the first PTC layer;

(d) firing the resulting structure comprising a PTC material layer, two ohmic layers and two metal layers, in accordance with a second temperature profile, to provide a first PTC structure, wherein the ohmic layer and metal layer on each side of the PTC material layer form corresponding first and second electrodes of the first PTC structure disposed on a top and bottom surface of the first PTC structure, respectively;

(e) repeating steps (a)-(d) above with a second set of layers comprising a PTC material layer, two ohmic layers, and two external metal layers, to form a second PTC structure having third and fourth electrodes disposed on top and bottom surfaces, respectively, of the second PTC structure, wherein the third and fourth electrodes each comprise an ohmic layer and a metal layer;

(f) stacking the first and second PTC structures on top of one another such that the second electrode of the first PTC structure is in electrical contact with the third electrode of the second PTC structure;

(g) soldering or bonding the second electrode to the third electrode; and (h) electrically connecting the first and fourth electrodes to a first contact lead of the device and electrically connecting the second and third electrodes to a second contact lead of the device.

2. The method of claim 1 wherein the PTC material layers comprise a metal-ceramic composite PTC material.

3. The method of claim 2 wherein a metal powder comprises less than 50% of the volume of the metal-ceramic composite material.

4. The method of claim 1 wherein said ohmic layers comprise silver and least one base metal selected from a group consisting of: tin, zinc, nickel, indium, gallium, and copper.

5. The method of claim 1 wherein the first and second temperature profiles each comprise an approximately 500-650-650-500° C. temperature profile, wherein firing is successively performed for a predetermined amount of time at each temperature.

6. The method of claim 1 wherein said metal layers each comprise pure silver.

7. A multi-layer PTC device made in accordance with the method of claim 1.

8. A multi-layer PTC device made in accordance with a method, comprising the steps of:

(a) sintering a first PTC material layer having a first and second electrode layer on each side of the first PTC material layer, respectively, in accordance with a first predetermined temperature profile to create a first PTC structure, wherein the first predetermined temperature profile does not include any temperatures exceeding 900° C.;

(b) sintering a second PTC material layer having a third and fourth electrode layer on each side of the second PTC material layer, respectively, in accordance with a second predetermined temperature profile to create a second PTC structure, wherein the second predetermined temperature profile does not include any temperatures exceeding 900° C.;

(c) stacking the first and second PTC structures on top of one another such that the second electrode layer of the first PTC structure is in electrical contact with the third electrode layer of the second PTC structure; and (d) electrically connecting the first and fourth electrode layers to a first contact lead of the device and electrically connecting the second and third electrode layers to a second contact lead of the device.

9. The method of claim 8 wherein the PTC material layers comprise a metal-ceramic composite PTC material.

10. The method of claim 9 wherein a metal powder comprises less than 50% of the volume of the metal-ceramic composite material.

11. The method of claim 8 wherein the first and second temperature profiles each comprise an approximately 500-650-650-500° C. temperature profile, wherein firing is successively performed for a predetermined amount of time at each temperature.

* * * * *